US009267460B2

(12) United States Patent
Carey et al.

(10) Patent No.: US 9,267,460 B2
(45) **Date of Patent: *Feb. 23, 2016**

(54) SYSTEM AND METHOD FOR ESTIMATING HIGH-PRESSURE FUEL LEAKAGE IN A COMMON RAIL FUEL SYSTEM

(71) Applicant: CUMMINS INC., Columbus, IN (US)

(72) Inventors: David M. Carey, Greenwood, IN (US); Donald J. Benson, Columbus, IN (US); Sanjay Manglam, Franklin, IN (US); Paul V. Moonjelly, Columbus, IN (US)

(73) Assignee: Cummins Inc., Columbus, IN (US)

( * ) Notice: Subject to any disclaimer, the term of this patent is extended or adjusted under 35 U.S.C. 154(b) by 247 days.

This patent is subject to a terminal disclaimer.

(21) Appl. No.: 13/946,409

(22) Filed: Jul. 19, 2013

(65) Prior Publication Data

US 2015/0020777 A1 Jan. 22, 2015

(51) Int. Cl.

| | |
|---|---|
| ***F02M 1/00*** | (2006.01) |
| ***F02D 41/38*** | (2006.01) |
| ***F02D 41/22*** | (2006.01) |
| *F02D 41/28* | (2006.01) |

(52) U.S. Cl.

CPC ..... *F02D 41/3845* (2013.01); *F02D 41/22* (2013.01); *F02D 2041/225* (2013.01); *F02D 2041/286* (2013.01); *F02D 2200/0602* (2013.01); *F02D 2200/0606* (2013.01)

(58) Field of Classification Search

CPC ..... F02M 69/045; F02D 2041/225; F02D 2041/226; F02D 2041/228

USPC ..... 123/445, 456, 457, 467, 479, 480

See application file for complete search history.

(56) References Cited

U.S. PATENT DOCUMENTS

| | | | | |
|---|---|---|---|---|
| 4,884,545 | A | 12/1989 | Mathis | |
| 4,903,669 | A | 2/1990 | Groff et al. | |
| 5,201,296 | A | 4/1993 | Wunning et al. | |
| 5,261,366 | A | 11/1993 | Regueiro | |
| 5,445,019 | A | 8/1995 | Glidewell et al. | |
| 5,535,621 | A | 7/1996 | Glidewell et al. | |
| 5,806,490 | A | 9/1998 | Nogi et al. | |
| 6,088,647 | A | 7/2000 | Hemberger et al. | |
| 6,105,554 | A * | 8/2000 | Nishiyama | 123/436 |
| 6,557,530 | B1 | 5/2003 | Benson et al. | |

(Continued)

FOREIGN PATENT DOCUMENTS

EP 2 295 775 A1 3/2011

OTHER PUBLICATIONS

International Search Report and Written Opinion of corresponding International Application No. PCT/US 14/46967, issued Oct. 22, 2014, 6 pgs.

*Primary Examiner* — John Kwon

(74) *Attorney, Agent, or Firm* — Faegre Baker Daniels LLP

(57) ABSTRACT

A system and method for measuring fuel pressure decreases in a fuel accumulator of an internal combustion engine is provided. The system includes the ability to stop a fuel flow to a fuel accumulator of the engine. Pressure signals are transmitted to a control system of the engine until the fuel pressure in the fuel accumulator drops by a predetermined amount, at which time fuel flow is re-enabled. The pressure signals are then analyzed to determine the amount or quantity of fuel delivered by each fuel injector. The system and method maintain engine and emissions performance by limiting the amount of fuel pressure decrease in the fuel accumulator.

11 Claims, 4 Drawing Sheets

(56) References Cited

U.S. PATENT DOCUMENTS

| | | | | |
|---|---|---|---|---|
| 6,567,758 | B1 | 5/2003 | Wuori | |
| 6,675,638 | B2 | 1/2004 | Pfitz | |
| 6,694,953 | B2 | 2/2004 | Barnes et al. | |
| 6,705,290 | B2 | 3/2004 | Puckett | |
| 6,981,489 | B2 | 1/2006 | Petrone et al. | |
| 7,027,907 | B2 | 4/2006 | LeGall et al. | |
| 7,093,586 | B2 | 8/2006 | Mattes | |
| 7,188,608 | B2 | 3/2007 | Wilson et al. | |
| 7,210,459 | B2 | 5/2007 | Shibata | |
| 7,249,596 | B2 | 7/2007 | Pellizzari et al. | |
| 7,275,511 | B1 | 10/2007 | Wright et al. | |
| 7,299,790 | B2 | 11/2007 | Okamoto et al. | |
| 7,421,329 | B2 | 9/2008 | Bowling et al. | |
| 7,558,665 | B1 | 7/2009 | Geveci et al. | |
| 7,606,655 | B2 | 10/2009 | Husted et al. | |
| 7,610,901 | B2 | 11/2009 | Bucher et al. | |
| 7,628,146 | B2 | 12/2009 | Kloppenburg et al. | |
| 7,650,778 | B2 | 1/2010 | Puckett et al. | |
| 7,717,088 | B2 | 5/2010 | Thomas | |
| 7,779,816 | B2 | 8/2010 | Doelker | |
| 7,788,015 | B2 | 8/2010 | Geveci et al. | |
| 7,789,068 | B2 | 9/2010 | Serra et al. | |
| 7,827,963 | B2 | 11/2010 | Li et al. | |
| 7,835,850 | B2 | 11/2010 | Nakata et al. | |
| 7,841,319 | B2 | 11/2010 | Thomas | |
| 7,980,120 | B2 | 7/2011 | Cinpinski et al. | |
| 8,047,175 | B2 | 11/2011 | Nishi et al. | |
| 8,100,112 | B2 | 1/2012 | Nakata et al. | |
| 8,789,511 | B2 | 7/2014 | Sakata | |
| 9,169,784 | B2 | 10/2015 | Moonjelly et al. | |
| 2003/0051709 | A1 | 3/2003 | Yu | |
| 2004/0055576 | A1* | 3/2004 | McCarthy, Jr. | 123/458 |
| 2004/0134268 | A1 | 7/2004 | Tuken et al. | |
| 2004/0149253 | A1 | 8/2004 | Kikuchi et al. | |
| 2004/0194762 | A1 | 10/2004 | Okamoto | |
| 2005/0061297 | A1 | 3/2005 | Oono | |
| 2005/0126538 | A1 | 6/2005 | Warne et al. | |
| 2006/0107927 | A1 | 5/2006 | Yamamoto | |
| 2007/0079808 | A1* | 4/2007 | Takahashi | 123/447 |
| 2007/0079809 | A1 | 4/2007 | Oono | |
| 2008/0059039 | A1 | 3/2008 | Nakagawa et al. | |
| 2008/0216797 | A1 | 9/2008 | Oono | |
| 2008/0236547 | A1 | 10/2008 | Takahashi et al. | |
| 2009/0020630 | A1 | 1/2009 | Yan | |
| 2009/0095244 | A1 | 4/2009 | Leone et al. | |
| 2009/0177366 | A1 | 7/2009 | Achleitner et al. | |
| 2009/0188472 | A1 | 7/2009 | Ulrey et al. | |
| 2009/0241642 | A1 | 10/2009 | Kyllingstad | |
| 2009/0255503 | A1 | 10/2009 | Fujiwara | |
| 2010/0250102 | A1 | 9/2010 | Imai et al. | |
| 2011/0030655 | A1 | 2/2011 | Kaneko | |
| 2011/0041808 | A1 | 2/2011 | Li | |
| 2011/0232610 | A1 | 9/2011 | Okamoto | |
| 2011/0253106 | A1 | 10/2011 | Bartsch et al. | |
| 2013/0000606 | A1 | 1/2013 | Watanabe et al. | |
| 2013/0013174 | A1 | 1/2013 | Nistler et al. | |
| 2013/0013175 | A1 | 1/2013 | Nistler et al. | |
| 2014/0224218 | A1 | 8/2014 | Carey et al. | |
| 2014/0224219 | A1 | 8/2014 | Carey et al. | |
| 2014/0224220 | A1* | 8/2014 | Moonjelly et al. | 123/447 |
| 2014/0224223 | A1 | 8/2014 | Benson et al. | |

* cited by examiner

SYSTEM AND METHOD FOR ESTIMATING HIGH-PRESSURE FUEL LEAKAGE IN A COMMON RAIL FUEL SYSTEM

TECHNICAL FIELD

This disclosure relates to a system and method for measuring a fuel leakage rate from a fuel system of an internal combustion engine.

BACKGROUND

All fuel systems have a certain amount of fuel leakage because of clearances between components. However, some fuel systems have relatively high fuel leakage for lubrication, cooling, and other purposes. Even though fuel leakage may have desirable benefits, fuel leakage rates may change with time and may exceed predetermined limits.

SUMMARY

This disclosure provides a system for determining a rate of fuel leakage in a fuel system of an internal combustion engine having a plurality of combustion chambers; the system comprises a fuel accumulator, a sensor, a plurality of fuel injectors, and a control system. The fuel accumulator is positioned to receive a fuel flow. The sensor is adapted to detect fuel pressure in the fuel accumulator and to transmit a pressure signal indicative of the fuel pressure in the fuel accumulator. Each fuel injector of the plurality of fuel injectors is operable to deliver a quantity of fuel from the fuel accumulator to one of the plurality of combustion chambers. The control system is adapted to receive the pressure signal, to transmit a control signal to stop the fuel flow to the fuel accumulator, to determine the rate of fuel leakage in the fuel system, to determine a decrease in the fuel pressure by a predetermined amount based on the pressure signal, and to transmit a control signal to restart the fuel flow to the fuel accumulator based on the predetermined amount of decrease in the fuel pressure.

This disclosure also provides a method of determining an amount of fuel leakage in a fuel system of an internal combustion engine. The method comprises providing a fuel flow to a fuel accumulator, stopping the fuel flow to the fuel accumulator to define a beginning of a termination event and determining a fuel pressure in the fuel accumulator during the termination event. The method further comprises determining a decrease in the fuel pressure by a predetermined amount based on the pressure signal, restarting the fuel flow to the fuel accumulator when the fuel pressure in the fuel accumulator decreases by the predetermined amount, defining an end of the termination event, and determining the rate of fuel leakage from the fuel system based on the fuel pressure.

This disclosure also provides a system for determining a rate of fuel leakage in a fuel system of an internal combustion engine, the system comprising a fuel accumulator, a sensor, a plurality of fuel injectors, and a control system. The fuel accumulator is positioned to receive a fuel flow. The sensor is adapted to detect fuel pressure in the fuel accumulator and to transmit a pressure signal indicative of the fuel pressure in the fuel accumulator. Each fuel injector of the plurality of fuel injectors is operable to deliver a quantity of fuel from the fuel accumulator to a combustion chamber. The control system is adapted to receive the pressure signal, to transmit a control signal to stop the fuel flow to the fuel accumulator, to determine the rate of fuel leakage in the fuel system, and to transmit a control signal to restart the fuel flow to the fuel accumulator.

Advantages and features of the embodiments of this disclosure will become more apparent from the following detailed description of exemplary embodiments when viewed in conjunction with the accompanying drawings.

DETAILED DESCRIPTION

Figure 1:
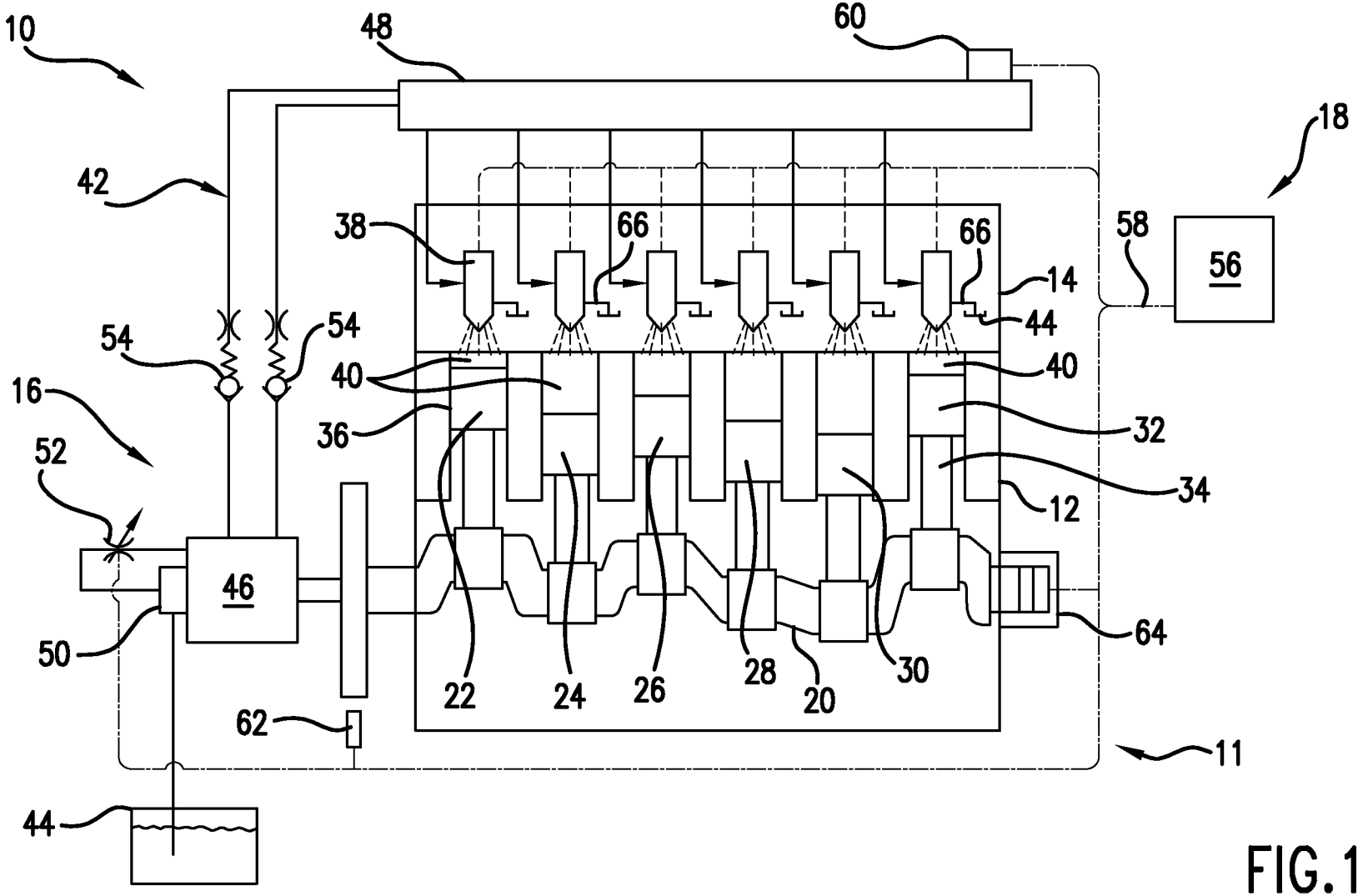
FIG. 1 is a schematic of an internal combustion engine incorporating an exemplary embodiment of the present disclosure.

Referring to FIG. 1, a portion of an internal combustion engine incorporating an exemplary embodiment of the present disclosure is shown as a simplified schematic and generally indicated at 10. Engine 10 includes an engine body 11, which includes an engine block 12 and a cylinder head 14 attached to engine block 12, a fuel system 16, and a control system 18. Control system 18 receives signals from sensors located on engine 10 and transmits control signals to devices located on engine 10 to control the function of those devices, such as one or more fuel injectors.

One challenge with fuel systems is that they have a certain amount of fuel leakage, which may be due to fuel leakage through control valves, lubrication of certain components, cooling of components, and other purposes. While a certain volume of fuel leakage is anticipated and provides benefits to engine 10, when fuel leakage exceeds a predetermined rate limit, the fuel leakage decreases the efficiency of engine 10 due to the need to replace the leaked fuel. Thus, it is beneficial to measure the fuel leakage rate from fuel system 16 to determine whether the fuel leakage rate is less than the predetermined rate limit. However, measuring such fuel leakage can be challenging because engine 10 is a dynamic environment and signals indicative of a fuel flow rate, such as may occur through a drain circuit, may be sufficiently noisy that such signals may be too inaccurate to provide early warning of excessive fuel leakage. The system and method of the present disclosure provide improved determination of fuel leakage from fuel system 16, providing the opportunity to warn an operator of the need to service engine 10 because of excessive fuel leakage from fuel system 16. The apparatus and method described hereinbelow provides measurements of fuel leakage from fuel system 16 while preventing an undesirable drop in fuel pressure in a fuel accumulator or fuel rail of fuel system 16 of engine 10. Control system 18 is able to stop the flow of fuel to the fuel accumulator or rail of engine 10. While the fuel flow to the fuel accumulator is stopped, which forms a termination event, control system 18 receives signals from a pressure sensor associated with the fuel accumulator indicative of the fuel pressure in the fuel accumulator. By ceasing fuel flow based on a fuel pressure decrease in the accumulator rather than time, the performance and emissions of engine 10 are maintained.

Engine body 12 includes a crank shaft 20, a #1 piston 22, a #2 piston 24, a #3 piston 26, a #4 piston 28, a #5 piston 30, a #6 piston 32, and a plurality of connecting rods 34. Pistons 22, 24, 26, 28, 30, and 32 are positioned for reciprocal movement in a plurality of engine cylinders 36, with one piston positioned in each engine cylinder 36. One connecting rod 34 connects each piston to crank shaft 20. As will be seen, the movement of the pistons under the action of a combustion process in engine 10 causes connecting rods 34 to move crankshaft 20.

A plurality of fuel injectors 38 are positioned within cylinder head 14. Each fuel injector 38 is fluidly connected to a combustion chamber 40, each of which is formed by one piston, cylinder head 14, and the portion of engine cylinder 36 that extends between the piston and cylinder head 14.

Fuel system 16 provides fuel to injectors 38, which is then injected into combustion chambers 40 by the action of fuel injectors 38, forming one or more injection event. Fuel system 16 includes a fuel circuit 42, a fuel tank 44, which contains a fuel, a high-pressure fuel pump 46 positioned along fuel circuit 42 downstream from fuel tank 44, and a fuel accumulator or rail 48 positioned along fuel circuit 42 downstream from high-pressure fuel pump 46. While fuel accumulator or rail 48 is shown as a single unit or element, accumulator 48 may be distributed over a plurality of elements that transmit or receive high-pressure fuel, such as fuel injector(s) 38, high-pressure fuel pump 46, and any lines, passages, tubes, hoses and the like that connect high-pressure fuel from high-pressure fuel pump 46 to the plurality of elements. Fuel system 16 also includes an inlet metering valve 52 positioned along fuel circuit 42 upstream from high-pressure fuel pump 46 and one or more outlet check valves 54 positioned along fuel circuit 42 downstream from high-pressure fuel pump 46 to permit one-way fuel flow from high-pressure fuel pump 46 to fuel accumulator 48. Though not shown, additional elements may be positioned along fuel circuit 42. For example, inlet check valves may be positioned downstream from inlet metering valve 52 and upstream from high-pressure fuel pump 46, or inlet check valves may be incorporated in high-pressure fuel pump 46. Inlet metering valve 52 has the ability to vary or shut off fuel flow to high-pressure fuel pump 46, which thus shuts off fuel flow to fuel accumulator 48. Fuel circuit 42 connects fuel from fuel accumulator 48 to fuel injectors 38, which then provide controlled amounts of fuel to combustion chambers 40. Engine 10 also includes a drain circuit 66 positioned to connect fuel leakage from fuel injectors 38 and from other fuel system 16 locations to fuel tank 44. Such fuel leakage may be from operation of valves in fuel injectors 38, from lubrication of fuel injectors 38, and from other functions of fuel injectors 38 and fuel system 16. Fuel system 16 may also include a low-pressure fuel pump 50 positioned along fuel circuit 42 between fuel tank 44 and high-pressure fuel pump 46. Low-pressure fuel pump 50 provides a nearly constant pressure to inlet metering valve 52 to provide for pressure controllability at inlet metering valve 52.

Control system 18 may include a control module 56 and a wire harness 58. Many aspects of the disclosure are described in terms of sequences of actions to be performed by elements of a computer system or other hardware capable of executing programmed instructions, for example, a general purpose computer, special purpose computer, workstation, or other programmable data processing apparatus. It will be recognized that in each of the embodiments, the various actions could be performed by specialized circuits (e.g., discrete logic gates interconnected to perform a specialized function), by program instructions (software), such as logical blocks, program modules etc. being executed by one or more processors (e.g., one or more microprocessors, a central processing unit (CPU), and/or an application specific integrated circuit), or by a combination of both. For example, embodiments can be implemented in hardware, software, firmware, middleware, microcode, or any combination thereof. The instructions can be program code or code segments that perform necessary tasks and can be stored in a non-transitory machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

The non-transitory machine-readable medium can additionally be considered to be embodied within any tangible form of computer readable carrier, such as solid-state memory, magnetic disk, and optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information.

It should be noted that the system of the present disclosure is illustrated and discussed herein as having various modules and units which perform particular functions. It should be understood that these modules and units are merely schematically illustrated based on their function for clarity purposes, and do not necessarily represent specific hardware or software. In this regard, these modules, units and other components may be hardware and/or software implemented to substantially perform their particular functions explained herein. The various functions of the different components can be combined or segregated as hardware and/or software modules in any manner, and can be useful separately or in combination. Input/output or I/O devices or user interfaces including but not limited to keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Control system 18 also includes an accumulator pressure sensor 60 and a crank angle sensor. While sensor 60 is described as being a pressure sensor, sensor 60 may be other devices that may be calibrated to provide a pressure signal that represents fuel pressure, such as a force transducer, strain gauge, or other device. The crank angle sensor may be a toothed wheel sensor 62, a rotary Hall sensor 64, or other type of device capable of measuring the rotational angle of crankshaft 20. Control system 18 uses signals received from accumulator pressure sensor 60 and the crank angle sensor to determine the combustion chamber receiving fuel, which is then used to analyze the signals received from accumulator pressure sensor 60, described in more detail hereinbelow.

Control module 56 may be an electronic control unit or electronic control module (ECM) that may monitor conditions of engine 10 or an associated vehicle in which engine 10 may be located. Control module 56 may be a single processor, a distributed processor, an electronic equivalent of a processor, or any combination of the aforementioned elements, as well as software, electronic storage, fixed lookup tables and the like. Control module 56 may include a digital or analog circuit. Control module 56 may connect to certain components of engine 10 by wire harness 58, though such connection may be by other means, including a wireless system. For example, control module 56 may connect to and provide control signals to inlet metering valve 52 and to fuel injectors 38.

When engine 10 is operating, combustion in combustion chambers 40 causes the movement of pistons 22, 24, 26, 28, 30, and 32. The movement of pistons 22, 24, 26, 28, 30, and 32 causes movement of connecting rods 34, which are drivingly connected to crankshaft 20, and movement of connecting rods 34 causes rotary movement of crankshaft 20. The angle of rotation of crankshaft 20 is measured by engine 10 to aid in timing of combustion events in engine 10 and for other purposes. The angle of rotation of crankshaft 20 may be measured in a plurality of locations, including a main crank pulley (not shown), an engine flywheel (not shown), an engine camshaft (not shown), or on the camshaft itself. Measurement of crankshaft 20 rotation angle may be made with toothed wheel sensor 62, rotary Hall sensor 64, and by other techniques. A signal representing the angle of rotation of crankshaft 20, also called the crank angle, is transmitted from toothed wheel sensor 62, rotary Hall sensor 64, or other device to control system 18.

Crankshaft 20 drives high-pressure fuel pump 46 and low-pressure fuel pump 50. The action of low-pressure fuel pump 50 pulls fuel from fuel tank 44 and moves the fuel along fuel circuit 42 toward inlet metering valve 52. From inlet metering valve 52, fuel flows downstream along fuel circuit 42 through inlet check valves (not shown) to high-pressure fuel pump 46. High-pressure fuel pump 46 moves the fuel downstream along fuel circuit 42 through outlet check valves 54 toward fuel accumulator or rail 48. Inlet metering valve 52 receives control signals from control system 18 and is operable to block fuel flow to high-pressure fuel pump 46. Inlet metering valve 52 may be a proportional valve or may be an on-off valve that is capable of being rapidly modulated between an open and a closed position to adjust the amount of fluid flowing through the valve.

Fuel pressure sensor 60 is connected with fuel accumulator 48 and is capable of detecting or measuring the fuel pressure in fuel accumulator 48. Fuel pressure sensor 60 sends signals indicative of the fuel pressure in fuel accumulator 48 to control system 18. Fuel accumulator 48 is connected to each fuel injector 38. Control system 18 provides control signals to fuel injectors 38 that determines operating parameters for each fuel injector 38, such as the length of time fuel injectors 38 operate and the number of fueling pulses per a firing or injection event period, which determines the amount of fuel delivered by each fuel injector 38.

Figure 2:
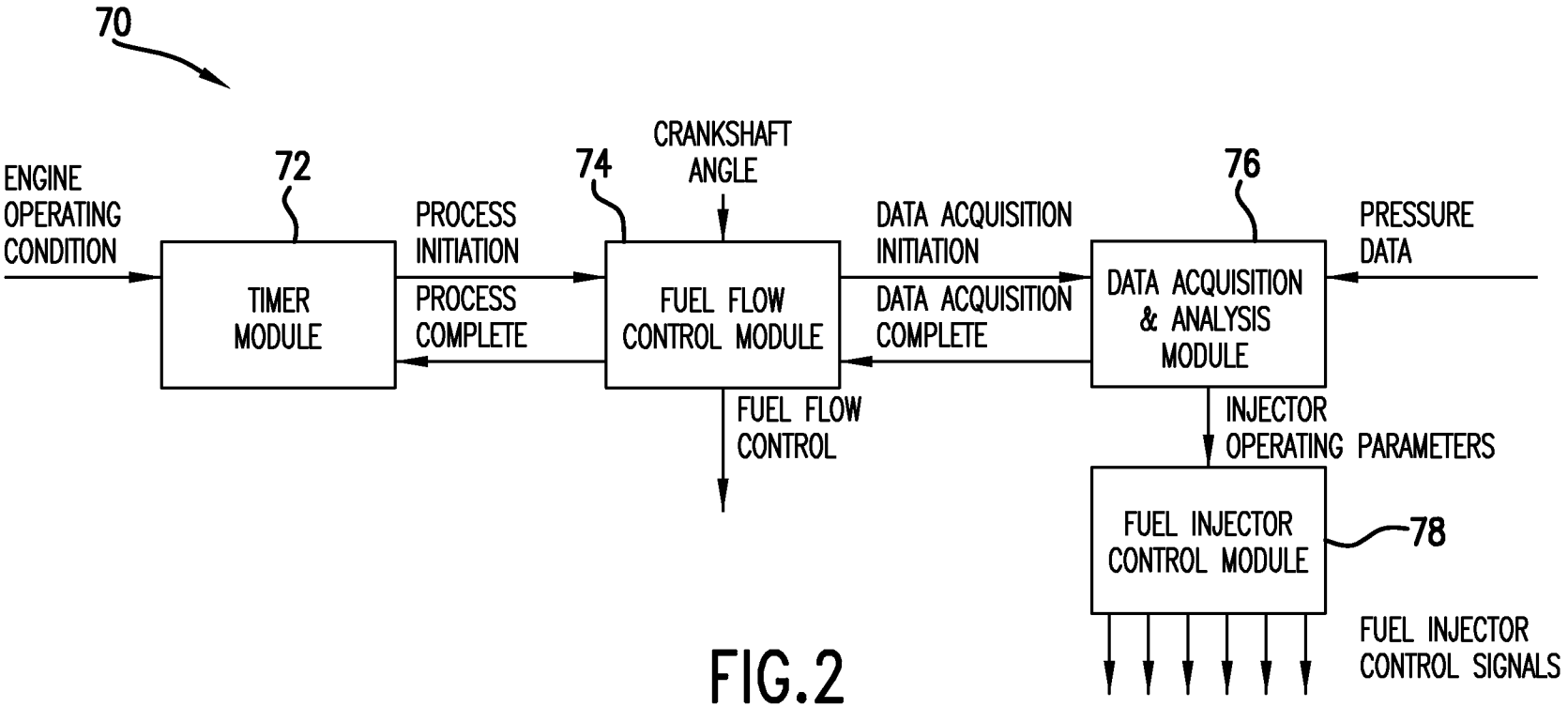
FIG. 2 is a data acquisition, analysis and control (DAC) module of the engine of FIG. 1 in accordance with an exemplary embodiment of the present disclosure.

Control system 18 includes a process that controls the components of engine 10 to enable measurement of fuel leakage from fuel system 16. Turning now to FIG. 2, a data acquisition, analysis and control (DAC) module 70 in accordance with an exemplary embodiment of the present disclosure is shown. DAC module 70 includes a timer module 72, a fuel flow control module 74, a data acquisition and analysis module 76, and a fuel injector control module 78.

Timer module 72 receives a signal indicative of the operating condition of engine 10 and a process complete signal from fuel flow control module 74. The function of timer module 72 is to initiate the data acquisition process of DAC module 70 when the operating condition of engine 10 permits and at a specific or predetermined interval. Timer module 72 also monitors the engine operating condition and may adjust the timing interval to include measurements under a variety of engine conditions, such as a variety of fueling quantities and accumulator pressure levels. Timer module 72 may also inhibit a new measurement if accumulator 48 remains at a constant pressure level or if fuel injectors 38 are commanded at the same fueling level, though such inhibitions may have a maximum length of time. Timer module 72 may also monitor the convergence of each fuel injector 38. A fuel injector 38 is converged when new measurements from the process described hereinbelow match the adapted or adjusted fueling characteristics, which means that the measurement interval may be increased to avoid unnecessary fuel flow stoppages. If convergence never occurs, the processes described below may indicate a system malfunction requiring operator intervention. Timer module may also limit the number of times fuel flow is stopped to avoid excessive fuel flow stoppages, which may be accomplished by overriding inlet metering valve 52. In order to initiate the data acquisition process, timer module 72 initiates or starts a timing process using either the operating condition of engine 10 or the completion of a previous data acquisition process. When engine 10 initially starts, timer module 72 receives an engine operating signal from control system 18 that indicates engine 10 is operating, which initiates a timer in timer module 72. When the timer reaches a specified or predetermined interval, which may be in the range of one to four hours and may be described as a drive cycle or an OBD (on-board diagnostics) cycle, timer module 72 transmits a process initiation signal to flow control module 74. Subsequent timing processes are initiated from the process complete signal received from flow control module 74.

Fuel flow control module 74 receives the process initiation signal from timer module 72, a data acquisition complete signal from data acquisition and analysis module 76, and a crankshaft angle signal from control system 18. Flow control module 74 provides the process complete signal to timer module 72, a data acquisition initiation signal to data acquisition and analysis module 76 and a fuel flow control signal to fuel system 16. The process initiation signal from timer module 72 causes flow control module 74 to wait for a predetermined crankshaft angle and, once the predetermined angle is reached, to send a fuel flow control signal to fuel system 16 that stops the fuel flow to accumulator 48, forming the start of a termination event. After transmitting the signal to stop fuel flow, flow control module 74 then sends the data acquisition initiation signal to data acquisition and analysis module 76. The data acquisition complete signal from data acquisition and analysis module 76 causes flow control module 74 to send the fuel flow control signal to fuel system 16 that re-starts the fuel flow to accumulator 48, ending the termination event. After transmitting the signal to re-start fuel flow, flow control module 74 transmits the process complete signal to timer module 72.

Data acquisition and analysis module 76 receives the data acquisition initiation signal from flow control module 74 and a fuel pressure data signal from fuel rail or accumulator pressure sensor 60, and provides one or more injector operating parameter signals to fuel injector control module 78 and the data acquisition complete signal to flow control module 74. When data acquisition and analysis module 76 receives the data acquisition initiation signal from flow control module 76, module 76 begins to store fuel pressure data signals from accumulator pressure sensor 60. Module 76 will acquire the fuel pressure data signals and analyze the fuel pressure data signals to determine when a predetermined fuel pressure decrease has been reached. Once the predetermined fuel pressure decrease has been reached, module 76 will complete the analysis of the fuel pressure data signals to determine whether the operating parameters for one or more fuel injectors 38 needs to be modified and whether the fuel leakage from fuel system 16 is less than a predetermined limit, described further hereinbelow. If one or more operating parameters for any fuel injector 38 require adjustment, module 76 will transmit the modified fuel injector operating parameters to fuel injector control module 78 for use in subsequent fuel injection events. Data acquisition and analysis module 76 also sends the data acquisition complete signal to flow control module 74.

Fuel injector control module 78 receives fuel injector operating parameters from data acquisition and analysis module 76 and provides signals to each fuel injector 38 that control the operation of each fuel injector 38. For example, the operating parameters may include the time of operation for each fuel injector 38, the number of fueling pulses from a fuel injector 38, and placement of a fuel injection event with respect to the crank angle or crankshaft angle. Though not shown, fuel injection control module 78 also receives information regarding a desired fuel quantity, desired start-of-injection timing, and other information that may be needed to control the operation of each fuel injector 38 properly.

Figure 3:
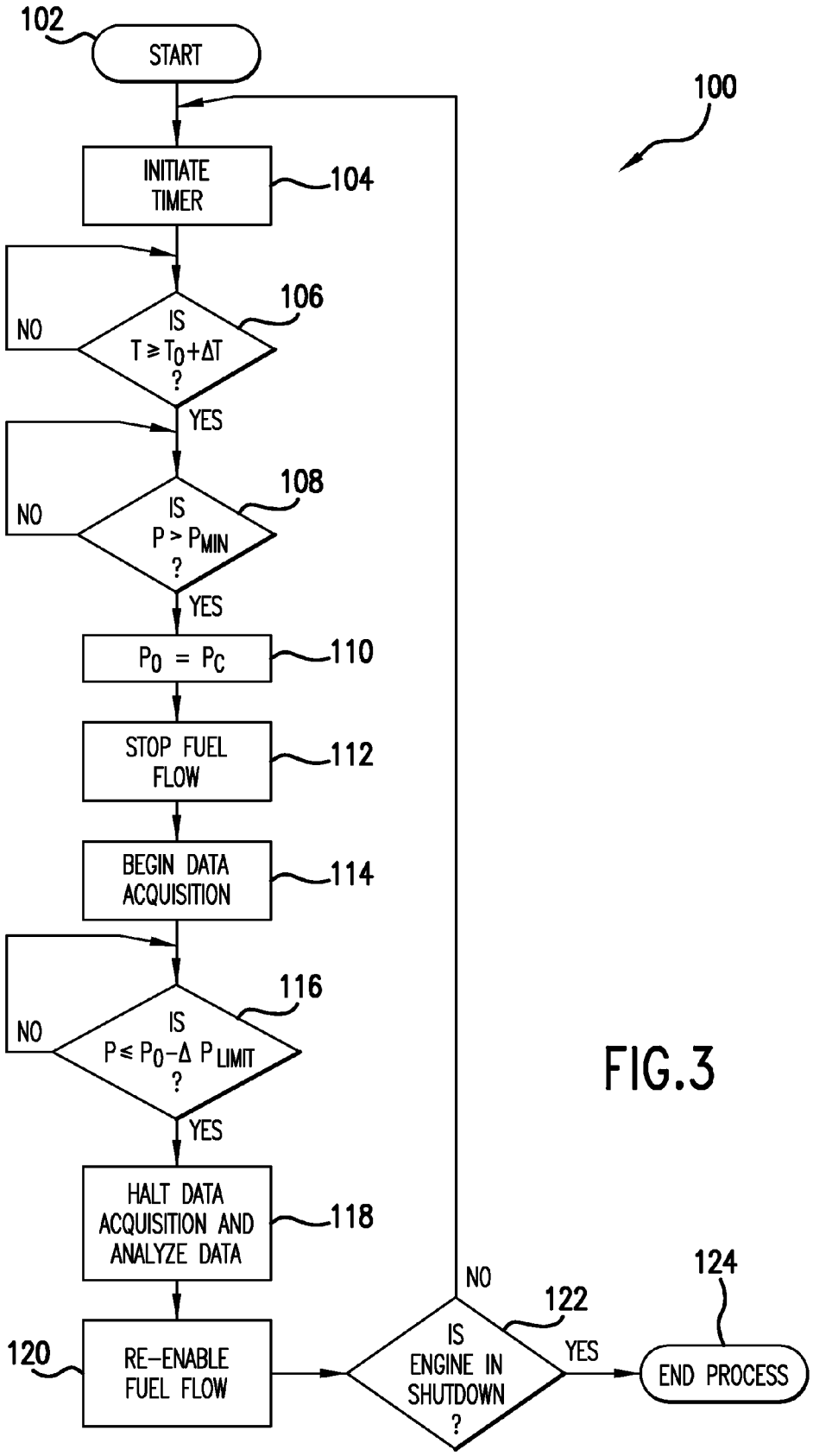
FIG. 3 is a process flow diagram for a data acquisition process of the DAC module of FIG. 2 in accordance with a first exemplary embodiment of the present disclosure.

Turning now to FIG. 3, a flow diagram describing a data acquisition process 100 of control system 18 in accordance with a first exemplary embodiment of the present disclosure is shown. Data acquisition process 100 may be distributed in one or more modules of control system 18, such as timer module 72, flow control module 74, and data acquisition and analysis module 76. Data acquisition process 100 is likely to be part of a larger process incorporated in control module 56 that controls some or all of the functions of engine 10. Thus, while FIG. 3 shows data acquisition process 100 as a self-contained process, it is likely that data acquisition process 100 is "called" by a larger process, and at the completion of data acquisition process 100 control is handed back to the calling process.

Data acquisition process 100 initiates with a process 102. Process 102 may include setting variables within data acquisition process 100 to an initial value, clearing registers, and other functions necessary for the proper functioning of data acquisition process 100. From process 102, control passes to a process 104. At process 104, a timer is initiated and a time $T_0$ is set. Data acquisition process 100 may use another timing function of engine 10 to establish an initial time $T_0$ for the requirements of data acquisition process 100. For convenience of explanation, the timing function is described as part of data acquisition process 100.

Data acquisition process 100 continues with a decision process 106. At process 106, data acquisition process 100 determines whether the current time T is equal to or greater than $T_0$ plus a predetermined or specific change in time $\Delta T$ since the timer initiated. In an exemplary embodiment of the disclosure, $\Delta T$ may be one hour. The time period may be greater or less than one hour, depending on measured changes in fuel delivered or on other conditions. While $\Delta T$ is described in this disclosure as a fixed or predetermined value, $\Delta T$ may be varied based on actual data. For example, if no adjustments to fuel injector 38 parameters are required for a lengthy period, such as one hour or more, $\Delta T$ may be incremented to a higher value, such as 30 minutes, by the action of one of the modules described herein. If T is less than $T_0$ plus $\Delta T$, data acquisition process 100 waits at decision process 106 until the present time is greater than or equal to $T_0$ plus $\Delta T$. As with initial time $T_0$, this timing function may be performed elsewhere in engine 10 and is included in this process for convenience of explanation. Once the condition of decision process 106 has been met, the process moves to a decision process 108.

At decision process 108, data acquisition process 100 determines whether the fuel pressure P in fuel accumulator 48 is greater than minimum fuel pressure $P_{MIN}$. The purpose of process 108 is to verify that there is sufficient fuel pressure in fuel accumulator 48 to guarantee collection of valid data for at least one piston. Thus, if the fuel pressure in fuel accumulator 48 is near a pressure level that will be insufficient for proper operation of fuel injectors 38, data acquisition process 100 will wait until high-pressure fuel pump 46 has increased the fuel pressure in fuel accumulator 48 to a suitable fuel pressure level. The minimum fuel pressure will depend on many factors, particularly the type of engine, the amount of fuel each fuel injector 38 typically delivers, and the capacity of high-pressure fuel pump 46. For example, if fuel injectors 38 operate most efficiently with accumulator fuel pressure at 1200 bar, then $P_{MIN}$ may be set at a normal operating fuel pressure of 1,700 bar or higher to assure accumulator 48 contains a normal operating fuel pressure even under high load conditions. In an exemplary embodiment, $P_{MIN}$ is 1700 bar. Data acquisition process 100 moves to a process 110 once the fuel pressure in fuel accumulator 48 has reached $P_{MIN}$.

At process 110, data acquisition process 100 sets fuel pressure $P_0$ to the current fuel pressure $P_C$ in fuel accumulator 48. Data acquisition process 100 then moves to a process 112. At process 112, control system 18 sends a control signal to inlet metering valve 52 to close, stopping fuel flow to high-pressure fuel pump 46, forming the start of a termination event. Control system 18 begins storing signals from accumulator pressure sensor 60 at a data acquisition process 114, beginning with crank angle 0 degrees plus an offset, which may be 20 degrees. The purpose of the offset is to accommodate the length of time it takes for inlet metering valve 52 to respond, and may also accommodate timing of fuel injection events. Data acquisition will proceed through the firing sequence, which may be piston 22, piston 30, piston 26, piston 32, piston 24, and piston 28, or piston #1, piston #5, piston #3, piston #6, piston #2, and piston #4. At a decision process 116, data acquisition process 100 determines whether the fuel pressure in fuel accumulator 48 is less than or equal to $P_0$ minus $\Delta P_{Limit}$, where $\Delta P_{Limit}$ is the maximum total fuel pressure decrease permissible in fuel accumulator 48. Once the condition of decision process 116 has been met, data acquisition process 100 moves to a process 118, where data acquisition from accumulator pressure sensor 60 is stopped, and the signals or data acquired is analyzed by control system 18, described in more detail hereinbelow. Though not shown in data acquisition process 100, process 100 may include an additional process during the data acquisition process that aborts the cutout event if the accumulator pressure drops below a preset level, regardless of any other condition. Data acquisition process 100 may also include a process that provides for multiple fuel cutout events, with each cutout event separated by an adjustable or calibratible interval, e.g., 15 seconds.

At a process 120, control system 18 sends a signal to inlet metering valve 52 to open, restore, enable, re-enable, start, or re-start fuel flow to high-pressure fuel pump 46 and fuel accumulator 48 and ending the termination event. While process 120 is shown as occurring after analysis of data in process 118, process 120 may be implemented first and then analysis of the data if the fuel flow to accumulator needs re-enabled quickly for operational reasons. At a decision process 122, data acquisition process 100 determines whether engine 10 is in a shutdown mode. If engine 10 is shutting down, then measurement of fuel delivery by fuel injectors 38 is no longer desirable and may lead to invalid data, so data acquisition process 100 ends at a process 124. If engine 10 is continuing to operate, data acquisition process 100 returns to process 104, where the timer is restarted and data acquisition process 100 continues as previously described.

While data acquisition process 100 is described in the context of six pistons, data acquisition process 100 may be used for any number of pistons. The only adjustment required for the process to function properly is to provide the crank angles for firing of the pistons, and the firing order.

Figure 4:
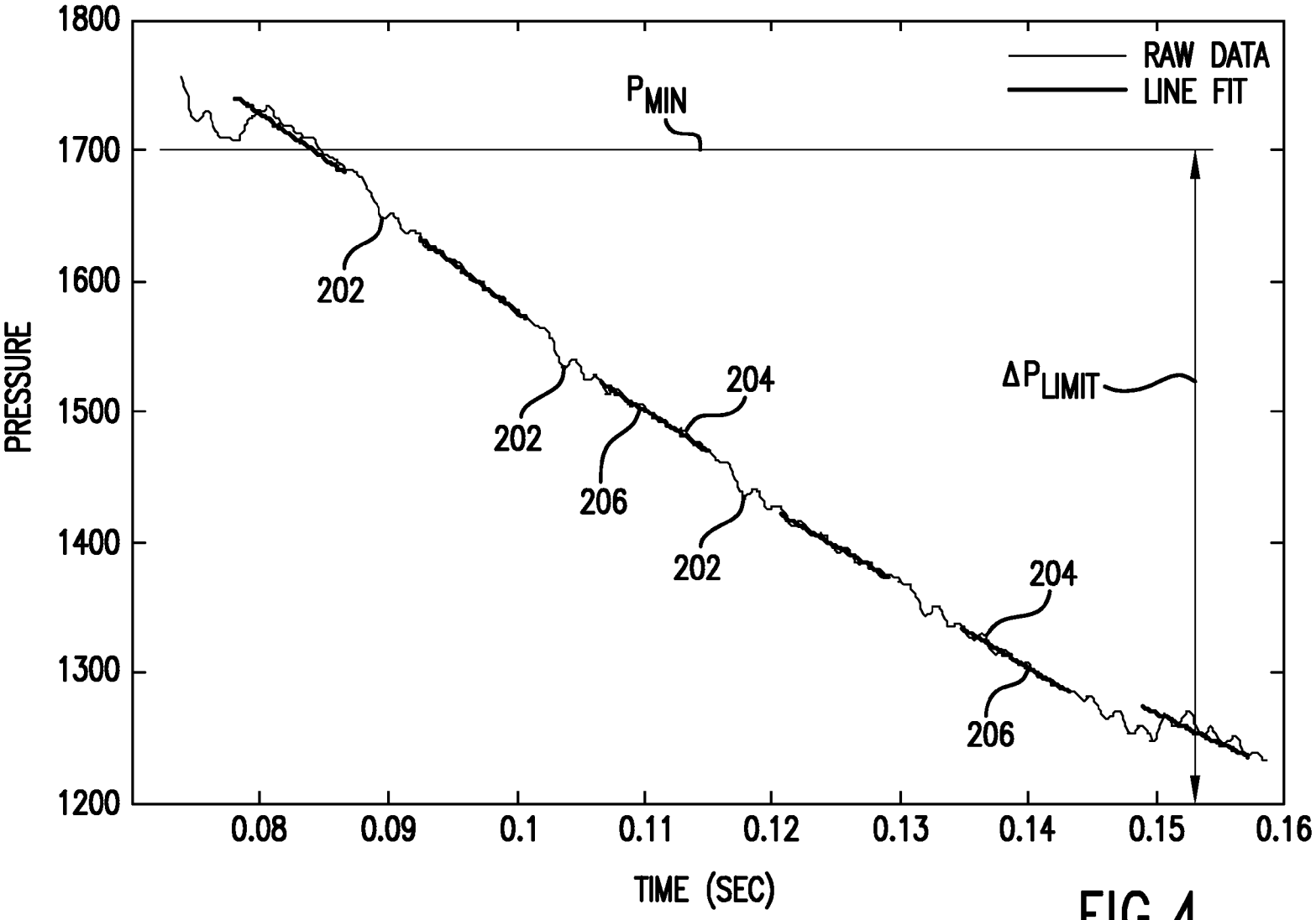
FIG. 4 is a graph showing data acquired during cessation of fuel flow to an accumulator of the internal combustion engine of FIG. 1.

FIG. 4 shows representative data acquired during the operation of the previously described processes. In the exemplary embodiment, the horizontal axis of FIG. 4 shows a time domain for the data acquired. The horizontal axis may also represent the crank angle of engine 10. The vertical axis shows exemplary fuel pressures of fuel accumulator 48. The value $P_{Min}$, which is used in process 108 of data acquisition process 100, is shown on the vertical axis. The value $\Delta P_{Limit}$, which sets the maximum total fuel pressure decrease permissible in fuel accumulator 48, is shown on the right hand side of the graph in FIG. 4.

One or more fuel injection events are represented by the data at curve portions 202. Between each injection event 202, raw pressure data at curve portions 204 illustrate pressure decreases caused by fuel leakage in fuel system 16 from fuel accumulator 48. In order to analyze the rate of fuel leakage, each curve portion 204 between each injection event 202 may be represented by a line fit 206. Because the cessation of fuel delivery to fuel accumulator 48 is based on the total fuel pressure decrease, i.e., $\Delta P_{Limit}$, only a limited number of fuel injection events 202 are represented in the data acquired during the period in which fuel flow to fuel accumulator 48 is halted. The benefit to limiting the pressure decrease in fuel accumulator 48 to $\Delta P_{Limit}$ is that fueling to combustion chambers 40 continues while data is acquired, thus eliminating the need to place engine 10 in a motoring or zero fueling condition, which is advantageous from the performance of engine 10 and operator perception of the operation of engine 10.

Once pressure data is acquired, which may be similar to the data shown in FIG. 4, the data is analyzed to determine the fuel leakage rate from fuel system 16 and fuel injectors 38. One of the many possible models may be as described in Equation (1).

$$\dot{P}=c_0+c_1\sqrt{P} \qquad \text{Equation (1)}$$

In Equation (1), P is the fuel pressure in fuel accumulator 48, $\dot{P}$ is the fuel leakage or pressure decay rate, and $c_0$ and $c_1$ are coefficients that need to be estimated. The coefficients may be estimated using a recursive least-square procedure, modified with an additive process noise covariance to enable the coefficients to learn, adapt, or adjust to new fuel leakage conditions, such as might occur in the event of a failure, such as is shown in Equation (2).

$$\begin{bmatrix} c_0 \\ c_1 \end{bmatrix}_{j+1} = \begin{bmatrix} c_0 \\ c_1 \end{bmatrix}_j + K * \left\{ y_j - H_j * \begin{bmatrix} c_0 \\ c_1 \end{bmatrix}_j \right\} \qquad \text{Equation (2)}$$

The relationships shown in Equations (3) through (10) provide the definitions for Equation (2).

$$j = \text{The } jth \text{ update} \qquad \text{Equation (3)}$$

$$y_j = \text{The } jth \text{ instantaneous pressure decay rate measurement} \qquad \text{Equation (4)}$$

$$H_j = \begin{bmatrix} 1 & \sqrt{P_j} \end{bmatrix} \ (A1 \times 2 \text{ matrix}) \qquad \text{Equation (5)}$$

$$X_{j-1} = X_{j-1} + W \qquad \text{Equation (6)}$$

$$K = \frac{X_{j-1} * H_j^T}{[(H_j * X_{j-1} * H_j^T) + R]} \qquad \text{Equation (7)}$$

$$X_j = [1 - (K * H_j)] * X_{j-1} \qquad \text{Equation (8)}$$

$$W = \begin{bmatrix} w_{c_0} & 0 \\ 0 & w_{c_1} \end{bmatrix} \qquad \text{Equation (9)}$$

$$X_0 = \begin{bmatrix} \sigma_{c_0}^2 & 0 \\ 0 & \sigma_{c_1}^2 \end{bmatrix} \qquad \text{Equation (10)}$$

In Equation (7), the term "R" is a variable parameter that can be calibrated considering an expected noise level associated with individual leakage rate measurements. In Equation (9), the terms "$w_{c_0}$" and "$w_{c_1}$" are variances of white noise inputs to process noise. Equation (10) represents initial coefficient variances. The term "$X_0$" is a 2×2 matrix that represents the variance in the coefficient estimates. For the initial time step, or the first time this matrix is used, the $X_0$ matrix needs to be appropriately initialized. The initial values for $\sigma_{c_0}^2$ and $\sigma_{c_1}^2$ may be determined by performing the recursive calculations above for a large number of measurements using pre-existing data, starting with an arbitrarily large diagonal covariance matrix. In addition to the above values, the coefficients $c_0$ and $c_1$ need to be initialized for the initial time step, and can be set to anticipated values for a nominal fuel leakage condition. In one example, a fuel system designed to be leak-free may use initial or nominal values of coefficients $c_0$ and $c_1$ of zero. For other fuel systems having a non-zero leakage rate, the nominal values of coefficients $c_0$ and $c_1$ represent the expected average leakage rate for a new engine. However, it should be understood that because convergence for this model is typically fast, the initial values of coefficients $c_0$ and $c_1$ are relatively unimportant. In the field, there is likely to be wide variation in the leakage condition among different engines, both those designed to be nominally "leak-free" and those designed with leakage, and the model described hereinabove is able to adapt to various leakage conditions rapidly. In an exemplary embodiment, coefficients $c_0$ and $c_1$ are stored in a non-volatile memory of control system 18 so that on each engine start the model would initialize with the most recent coefficient values from the previous cycle. While this model currently treats temperature as a constant, temperature could be included as an additional term in the leakage rate model. The process noise covariance, Equation (9), can be as shown, with diagonal element tuned to give a desired balance between performance or rate of convergence and noise rejection. The tuning process consists of assigning values to parameter R in Equation (7), the $w_{c_0}$ and $w_{c_1}$ noise intensity parameters in eq. 9, the initial $\sigma_{c_0}^2$ and $\sigma_{c_1}^2$ parameter values in Equation (10), and coefficient parameters $c_0$ and $c_1$. The value of R is a representation of the expected variance in individual leakage measurements, the values of $w_{c_0}$ and $w_{c_1}$ represent the maximum expected change in leakage condition per unit time, and the coefficients $c_0$ and $c_1$ represent the expected variance or uncertainty in leakage condition on a typical new engine. The values for parameters R, $w_{c_0}$, $w_{c_1}$, $\sigma_{c_0}^2$ and $\sigma_{c_1}^2$ can be calibrated once sufficient data is gained about the leakage measurement capability and the variability of leakage condition among different engines over time. In one example, the parameters may be calibrated by trial-and-error to achieve a desired convergence behavior. During operation of engine 10, coefficient estimates are updated using the equations above after each pump cutout event. Residual errors can be monitored to determine convergence, after which the coefficient estimates can be used to determine the fuel leakage condition of engine 10.

The fuel leakage condition may then be used as a diagnostic and to improve performance of a virtual fueling sensor algorithm. For example, if the predetermined fuel leakage rate is 10 mg/sec, and Equations (1) through (10) indicate the fuel leakage rate is >10 mg/sec, then a "check engine" light or indicator may be provided to an operator of engine 10. In another example, if the fuel leakage rate exceeds a predetermined fuel leakage rate by a greater amount, such as 12 mg/sec, then a "stop engine soon" light or other indicator may be provided to an operator of engine 10, indicating that the fuel leakage is such that engine 10 may be in peril of catastrophic failure. While the examples provided describe absolute fuel leakage rates, such rates may also be set as a percentage or ratio. For example, an initial fuel leakage rate may be measured at the beginning of engine 10 life, and the predetermined fuel leakage rate that would cause an operator alert might be a percentage increase in fuel leakage from the initially determined fuel leakage rate, such as a 20% increase in fuel leakage. Similarly, a higher increase in fuel leakage rate that might be indicative of an engine 10 catastrophic failure might be a 30% increase, which might cause an alert to an operator indicative of imminent engine failure.

While Equations (1) through (10) describe a mathematical model of the fuel leakage rate, other methods of modeling the fuel leakage rate can provide similar results, though the other models may require more non-transitory machine-readable memory or medium and more data. For example, because fuel leakage rates are related to temperature and pressure, tables may be used to store fuel leakage data during a variety of operating conditions, and these tables may then be used as a baseline for future comparisons. The tables used to store fuel leakage data may be adaptive tables that are updated with leakage rate measurement using methods similar to those described hereinabove for Equations (1) through (10). Because individual leakage rate measurements are noisy, these measurements would typically require some sort of filtering to remove noise, such as by averaging or by other noise decreasing techniques. Furthermore, while there are variations in leakage rates with temperature and pressure, initial data collection may be used to set maximum fuel leakage rates at all pressure conditions. For example, if initial fuel leakage is determined to be 5 mg/sec, then control system 18 may use the initial fuel leakage rate to establish predetermined maximum permissible leakage rates. For example, by using data collected from a plurality of engines, control system 18 may be pre-programmed to establish an initial operator notification level at three times the initial fuel leakage rate of 5 mg/sec, or 15 mg/sec, or 300% of the initial fuel leakage rate. As the tabular model data is improved with time, the maximum fuel leakage rate may be refined downward to an optimal predetermined fuel leakage rate, for example, 200% of the initial fuel leakage rate or 10 mg/sec, using the initial fuel leakage rate example provided.

The model described above is one of a number of models that may be used to describe the fuel leakage behavior and other mathematical models that provide the benefits of the calculations described above may be used.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A system for determining a rate of fuel leakage in a fuel system of an internal combustion engine having a plurality of combustion chambers, the system comprising:

a fuel accumulator positioned to receive a fuel flow;

a sensor adapted to detect fuel pressure in the fuel accumulator and to transmit a pressure signal indicative of the fuel pressure in the fuel accumulator;

a plurality of fuel injectors, each fuel injector operable to deliver a quantity of fuel from the fuel accumulator to one of the plurality of combustion chambers; and a control system adapted to receive the pressure signal, to transmit a control signal to stop the fuel flow to the fuel accumulator, to determine a fuel leakage rate in the fuel system, to determine a decrease in the fuel pressure by a predetermined amount based on the pressure signal, and to transmit a control signal to restart the fuel flow to the fuel accumulator based on the predetermined amount of decrease in the fuel pressure, wherein the fuel leakage rate is determined using a mathematical equation comprising $\dot{P}=c_0+c_1\sqrt{P}$, wherein $c_0$ and $c_1$ are coefficients that are estimated using a recursive least-square procedure modified with an additive process noise covariance.

2. The system of claim 1, wherein the fuel leakage rate is determined under a plurality of temperature and pressure conditions and stored in a tabular form.

3. The system of claim 1, wherein the fuel leakage rate is determined under a plurality of temperature and pressure conditions and represented by a topographical map.

4. The system of claim 1, wherein a condition signal is presented to an operator when the fuel leakage rate exceeds a predetermined fuel leakage rate limit.

5. A method of determining an amount of fuel leakage in a fuel system of an internal combustion engine, the method comprising:

providing a fuel flow to a fuel accumulator;

stopping the fuel flow to the fuel accumulator to define a beginning of a termination event;

determining a fuel pressure in the fuel accumulator during the termination event;

determining a decrease in the fuel pressure by a predetermined amount based on the pressure signal;

restarting the fuel flow to the fuel accumulator when the fuel pressure in the fuel accumulator decreases by the predetermined amount, defining an end of the termination event; and determining a fuel leakage rate from the fuel system based on the fuel pressure, wherein the fuel leakage rate is determined using a mathematical equation comprising $\dot{P}=c_0+c_1\sqrt{P}$, wherein $c_0$ and $c_1$ are coefficients that are estimated using a recursive least-square procedure modified with an additive process noise covariance.

6. The method of claim 5, wherein the fuel leakage rate is determined under a plurality of temperature and pressure conditions and stored in a tabular form.

7. The method of claim 5, wherein the fuel leakage rate is determined under a plurality of temperature and pressure conditions and represented by a topographical map.

8. The method of claim 5, wherein a condition signal is presented to an operator when the fuel leakage rate exceeds a predetermined fuel leakage rate limit.

9. A system for determining a rate of fuel leakage in a fuel system of an internal combustion engine, the system comprising:

a fuel accumulator positioned to receive a fuel flow;

a sensor adapted to detect fuel pressure in the fuel accumulator and to transmit a pressure signal indicative of the fuel pressure in the fuel accumulator;

a plurality of fuel injectors, each fuel injector operable to deliver a quantity of fuel from the fuel accumulator to a combustion chamber; and a control system adapted to receive the pressure signal, to transmit a control signal to stop the fuel flow to the fuel accumulator, to determine the rate of fuel leakage in the fuel system, and to transmit a control signal to restart the fuel flow to the fuel accumulator, wherein the fuel leakage rate is determined using a mathematical equation comprising $\dot{P}=c_0+c_1\sqrt{P}$, wherein $c_0$ and $c_1$ are coefficients that are estimated using a recursive least-square procedure modified with an additive process noise covariance.

10. The system of claim 9, wherein the fuel leakage rate is determined under a plurality of temperature and pressure conditions and stored in a tabular form.

11. The system of claim 9, wherein the fuel leakage rate is determined under a plurality of temperature and pressure conditions and represented by a topographical map.

* * * * *